United States Patent [19]

Frankosky

[11] 4,304,817

[45] Dec. 8, 1981

[54] POLYESTER FIBERFILL BLENDS

[75] Inventor: Michael S. Frankosky, Wilmington, Del.

[73] Assignee: E. I. DuPont de Nemours & Company, Wilmington, Del.

[21] Appl. No.: 15,933

[22] Filed: Feb. 28, 1979

[51] Int. Cl.[3] ..... D02G 3/36

[52] U.S. Cl. ..... 428/361; 57/254; 57/255; 57/257; 427/387; 427/389.5; 428/288; 428/362; 19/145.5

[58] Field of Search ..... 427/387, 390 R, 389.9; 428/359, 290, 360, 381, 288, 362; 8/115.7; 57/252, 253, 254, 255, 257

[56] References Cited

U.S. PATENT DOCUMENTS

| | | | |
|---|---|---|---|
| 3,271,189 | 9/1966 | Hofmann | 428/359 X |
| 3,452,128 | 6/1969 | Rains | 264/126 |
| 3,454,422 | 7/1969 | Mead et al. | 428/361 |
| 3,499,810 | 3/1970 | Wagle | 428/359 X |
| 3,772,137 | 11/1973 | Tolliver | 428/369 |
| 3,874,160 | 4/1975 | Kitazawa | 57/257 X |
| 4,040,371 | 8/1977 | Cooper et al. | 57/257 X |
| 4,068,036 | 1/1978 | Stanistreet | 428/296 |
| 4,118,531 | 10/1978 | Hauser | 428/224 |
| 4,129,675 | 12/1978 | Scott | 428/288 |

FOREIGN PATENT DOCUMENTS 1168759 10/1969 United Kingdom .

OTHER PUBLICATIONS

Business Week "Thinsulate' 3M Proves That Thin Can Be Warm" Jan. 22, 1979.

CPAI 1979 Textile Technology Forum, Toronto, 11-1-6-79 Paper by Cooper et al. "Thermal Performance of Sleeping Bags".

Research Disclosure Journal, Sep. 1975, p. 14, No. 13717.

Textile World, Feb. 1979 pp. 83-84.

"Fiberseal" 07-19-1977.

*Primary Examiner*—Michael R. Lusignan

*Assistant Examiner*—Thurman K. Page

[57] ABSTRACT

A fiberfill blend for making into a batt for heat-bonding of said batt to make it especially suitable for use in garments, consisting essentially of three ingredients: (a) two of the ingredients are crimped polyester staple fiber of lower denier than has commonly been used heretofore in polyester fiberfill, namely less than about 3 denier; (1) one of these polyester fiberfill ingredients is slickened with a durable coating; (2) the other of these polyester fiberfill ingredients is unslickened; each of ingredients (1) and (2) constitutes 25 to 75% of the polyester fiberfill (a); (b) the third ingredient is crimped binder fiber of a polymer having a melting point lower than that of the (a) ingredients; the binder fiber is present in amount 10 to 30% of the blend; the remaining 70 to 90% of the blend is the low denier polyester fiberfill. Such blends can be processed on conventional textile machinery to a stable thin batt, preferably by carding, needle-punching, and heating to activate the binder fibers, and these stable thin batts have high thermal insulation properties combined with attractive aesthetic properties that make them suitable for use in garments.

7 Claims, No Drawings

POLYESTER FIBERFILL BLENDS

TECHNICAL FIELD OF THE INVENTION

This invention relates to new polyester fiberfill blends, such as can be made into batts for heat-bonding and subsequent use as thermal insulation, e.g. insulating interliners in garments.

BACKGROUND

Polyester fiberfill is used commercially in many garments and other articles because of its desirable thermal insulating and aesthetic properties. Polyester fiberfill is generally used in garments in the form of bulky quilted batts. Most commercial polyester fiberfill has been in the form of crimped polyester staple fiber.

It has generally been considered desirable to maximize the bulk of the polyester fiberfill in the form in which it is eventually used, e.g. in a garment, since it has been found that increasing the bulk (or loft), and the durability thereof, increases the thermal insulation provided by the polyester fiberfill in the garment. It has, therefore, become conventional, for many purposes, to provide the polyester fiberfill with a coating of durable (i.e. wash-resistant) silicone slickener (cured polysiloxane), e.g. as disclosed in Hofmann U.S. Pat. No. 3,271,189 and Mead et al U.S. Pat. No. 3,454,422, because this provides the resulting articles with certain desirable properties, such as bulk-stability and fluffability. Most slickened and unslickened polyester fiberfill used in garments has generally been of denier about 5–6. An important reason is because it has been found that such denier has provided optimum bulk in use. Another prior suggestion for improving bulk has been the use of hollow polyester fiberfill, e.g. as disclosed in British Pat. No. 1,168,759 and Tolliver U.S. Pat. No. 3,772,137. Commercial use of hollow polyester fiberfill has increased significantly in recent years.

Research Disclosure Journal (September 1975) Article No. 13717, page 14, discloses the inclusion in polyester fiberfill of a specific low-melting-point binder fiber, poly(ethylene terephthalate/isophthalate), and its bonding to improve the stability and handling characteristics of the fiberfill, e.g. in batts, including batts to which polysiloxane slickeners have been applied. Mixtures of polyester fiberfill with lower melting binder fiber are also suggested elsewhere, e.g. in Scott U.S. Pat. No. 4,129,675, which discloses forming a web having a central band made from silicone-slickened polyester hollow fiberfill and outer bands made from a blend of unslickened hollow polyester fiberfill and binder fiber, and forming a batt having a center layer of such silicone-slickened polyester fiberfill and upper and bottom layers of said blend. Stanistreet U.S. Pat. No. 4,068,036 suggests the use of conjugate or bicomponent fibers for use as binder fibers in fiberfill blends.

SUMMARY OF THE INVENTION

The present invention provides new fiberfill blends consisting essentially of (a) from about 70 to about 90% by weight of crimped polyester staple fiber of denier about 0.5 to less than about 3, preferably of denier about 1.5, and preferably of poly(ethylene terephthalate), and (b) complementally, to total 100% by weight, from about 10 to about 30% of crimped staple binder fiber of a polymer having a melting point lower than that of said polyester fiber, preferably of denier 0.5 to 6, and preferably of an ethylene terephthalate/ethylene isophthalate copolyester containing 65–75 mole % of ethylene terephthalate residues and, complementally, 25 to 35 mole % of ethylene isophthalate residues and a stick temperature of about 90° C., wherein from about 25 to about 75% by weight of said polyester fiber is slickened with a cured polysiloxane coating and the remainder of the polyester fiber is unslickened.

Preferred proportions of the blend are, by weight, approximately as follows: 20–25% binder fiber; 25–40% unslickened polyester fiber; and the remainder (about 35–55%) slickened polyester fiber.

DETAILED DESCRIPTION OF THE INVENTION

As indicated, the new blends consist essentially of three ingredients:

(a) (1) slickened crimped polyester staple fiber of denier about 0.5 to about 3;

(a) (2) unslickened crimped polyester staple fiber of denier about 0.5 to about 3, and (b) crimped staple binder fiber of polymer having a melting point lower than that of said polyester fiber (a).

The preferred polyester staple fiber for (a) (1) and (2) is poly(ethylene terephthalate), which is available commercially at relatively low cost and provides good tactile aesthetics. This polyester fiber (a) constitutes the predominant proportion of the blend, namely about 70 to about 90% by weight, and remains in the form of polyester fiberfill in the batt and in any garment even after heat-bonding. Preferably, the slickened ingredient (1) and the unslickened ingredient (2) are present in equal proportions by weight (50:50). The proportion of slickened ingredient (1) may, however, be increased or decreased so that the ratio of slickened (1):unslickened (2) ingredients is from 3:1 to 1:3. The use of both slickened and unslickened polyester fiberfill in combination with binder fibers is an essential characteristic of the present invention. The slickened polyester fiber is included in the blend to impart softness, drapability and down-like aesthetics, and its presence allows greater control over any needle-punching operation. It is important that the slickener be durable in the sense of being wash-resistant, so that the slickener be retained on the polyester fiberfill during normal laundering. Suitable slickeners are polysiloxane coating compositions that are available commercially, and are mentioned in the prior art, e.g. in Hofmann U.S. Pat. No. 3,271,189 and Mead et al U.S. Pat. No. 3,454,422, the disclosures of which are incorporated herein by reference. More than one type of slickener may be used, if desired. Unslickened polyester fiber is included in the blend to provide potential bonding sites where the unslickened polyester fibers cross over. The combination, in the final heat-bonded batt, of the slickened polyester fibers (which are relatively free from bonding and provide desirable tactile aesthetics) with the unslickened fibers (which provide bonding sites at their cross-over points, and so make possible the provision of a thin stable bonded structure having good recoverable stretch properties) is an important characteristic of the new blends, which are precursors of the heat-bonded batts that are used in the final articles, e.g. garments.

It will be understood that, since an important characteristic of the invention is the use of both slickened polyester fiberfill and unslickened polyester fiberfill, slickener is applied to only a portion of the polyester fiberfill, and then cured as a coating thereon before blending the slickened fiberfill with the unslickened polyester fiberfill and the binder fiber. It will generally be convenient to use the same polyester fiberfill for both slickened and unslickened ingredients, but this is not essential.

The crimped polyester staple fiber (a) is of denier less than about 3. This denier is significantly lower than that of the regular denier polyester fiberfill (denier about 5–6) that has been used commercially hitherto, and is an important characteristic of the new blend. Use of regular denier polyester fiberfill is less desirable because its thermal insulation is inferior when used in a thin heat-bonded batt, or in a thin conventional batt. As the denier of the polyester fiberfill is decreased, however, it becomes more difficult to process the fiberfill on normal textile machinery, e.g. by carding, so it is undesirable to use polyester fiberfill of denier below about 0.5. A denier of about 1.5 is preferred for the polyester fiberfill (a). Unexpectedly, it has been found that use of polyester fiberfill of about 1.5 denier in thin batts can give thermal insulation essentially equivalent to that obtainable using an equivalent weight of polyolefin microfibers (denier 0.1 or less). Such microfibers have the disadvantage that they cannot be processed on normal textile machinery, e.g. by carding. It may be desirable to use hollow polyester fiberfill for at least part of the polyester fiberfill ingredients (a) (1) and/or (2), particularly when the denier of the polyester fiberfill is in the upper portion of the denier range, e.g. about 2.5 to 3.

The third essential ingredient of the blend is the binder fiber. During heat-setting, the binder fiber melts and bonds the unslickened polyester fiberfill at the cross-over points so that the bonded batt retains the desired configuration and density. The binder is used to give the heat-bonded batts stability and recoverable stretch, whereas this function was generally performed by the quilting in previous commercial garments. Because the binder is in the form of crimped fiber, like the polyester fiberfill, it can be processed on conventional textile machinery, e.g. a card, and be distributed throughout the blend. It is desirable, therefore, that the denier of the binder fiber be compatible with the denier of the polyester fiberfill (a) so that it can be distributed throughout the blend by conventional textile processing. The denier of the binder fiber will generally be about 0.5 to about 6. Ideally, it could be preferable to use binder fiber of substantially the same denier as that of the polyester staple fiber (a) but, as indicated hereinafter, a satisfactory result can be obtained by using binder fiber of higher denier.

The amount of binder fiber is about 10 to about 30% of the blend, and preferably about 20–25% of the blend (i.e. a proportion of 1:4 to 1:3 binder fiber:polyester fiber). As the proportion of binder in the blend is increased, the resulting heat-bonded batts will generally have greater rigidity, since the amount of bonding will depend most importantly on whether binder is available to bond the unslickened polyester fiber at the cross-over points, and the statistical probability of this increases with an increase in the amount of binder and with an increase in the amount of unslickened polyester fiber. It will be understood that binder fiber is not generally present as such in the heat-bonded batts, because the binder fiber will generally melt during the heat-bonding and will then congeal on the polyester fiber during the subsequent cooling stage.

The binder fiber has a lower melting point than the polyester fiberfill. The binder fiber preferably has a stick temperature above about 80° C. and below that of the polyester fiberfill. Preferred binder fiber has a stick temperature between 80° and 200° C. Fiber stick temperature is measured as described by Beaman and Cramer, J. Polymer Science 21, page 228 (1956). A flat brass block is heated electrically to raise the block temperature at a slow rate. The fiber sample is suspended under slight tension between glass rods over and near the surface of the block. At intervals, the fiber is pressed against the block for 5 seconds with a 200 gram brass weight which has been in continuous contact with the heated block. The fiber stick temperature is the temperature of the block when the fiber sticks to it for at least 2 seconds after removing the weight.

Suitable binder fibers are described in the aforesaid Research Disclosure Journal (September 1975) Article No. 13717 on page 14, Scott U.S. Pat. No. 4,129,675 and in Stanistreet U.S. Pat. No. 4,068,036, the disclosures of which are incorporated herein by reference.

A preferred binder is composed of an ethylene terephthalate/isophthalate copolymer having a terephthalate/isophthalate molar ratio of about 65–75/35–25, and having a stick temperature of about 90° C. Such binder fiber may be used in the form of cold-drawn, relaxed fiber that has low tendency to shrink.

The staple length and crimp level of the polyester fiberfill and of the binder fiber are those conventionally used, e.g. about 3 to 15 cm and 1 to 5 crimps/cm, respectively.

If desired, the binder fiber may be in the form of a bicomponent fiber, e.g. a sheath-core fiber, the sheath of which comprises the lower melting binder polymer, as suggested in Stanistreet U.S. Pat. No. 4,068,036. In such circumstances, it is desirable to use sufficient bicomponent fiber so that the amount of binder polymer is from about 10 to about 30% of the total weight of binder polymer and polyester fiberfill.

An advantage of the new polyester fiberfill blends, in contrast with microfibers (of denier 0.1 or less), is that the blends can be made and processed conveniently into batts using conventional textile machinery. Thus the new blends are generally formed by conventional blending of the ingredients and then processed through standard carding equipment to give an unbonded batt of desired weight. The batt is then needle-punched or otherwise reduced to the desired thickness, which increases the batt density. The needle-punching is preferably carried out on both sides of the batt. The needle-punched batt is heat-treated, e.g. in a conventional oven or by use of other heating means, to melt the binder fiber distributed throughout. The heat-treated batt is then cooled to below the melting point of the binder. By this means, it is possible to prepare a thin supple batt having excellent thermal insulation and tactile aesthetic properties. Such batts may be used as insulating interliners in garments in place of the more bulky quilted batts that have generally been used heretofore.

The invention is further described in the following Example, in which all percentages are by weight, and are calculated with respect to the total of the three essential ingredients, namely (a) (1) slickened polyester fiberfill, (a) (2) unslickened polyester fiberfill and (b) binder fiber, except as otherwise indicated.

EXAMPLE

Approximately 2 pounds (1.8 kg) of the following blend was prepared by hand-mixing:

POLYESTER FIBERFILL BLENDS

TECHNICAL FIELD OF THE INVENTION

This invention relates to new polyester fiberfill blends, such as can be made into batts for heat-bonding and subsequent use as thermal insulation, e.g. insulating interliners in garments.

BACKGROUND

Polyester fiberfill is used commercially in many garments and other articles because of its desirable thermal insulating and aesthetic properties. Polyester fiberfill is generally used in garments in the form of bulky quilted batts. Most commercial polyester fiberfill has been in the form of crimped polyester staple fiber.

It has generally been considered desirable to maximize the bulk of the polyester fiberfill in the form in which it is eventually used, e.g. in a garment, since it has been found that increasing the bulk (or loft), and the durability thereof, increases the thermal insulation provided by the polyester fiberfill in the garment. It has, therefore, become conventional, for many purposes, to provide the polyester fiberfill with a coating of durable (i.e. wash-resistant) silicone slickener (cured polysiloxane), e.g. as disclosed in Hofmann U.S. Pat. No. 3,271,189 and Mead et al U.S. Pat. No. 3,454,422, because this provides the resulting articles with certain desirable properties, such as bulk-stability and fluffability. Most slickened and unslickened polyester fiberfill used in garments has generally been of denier about 5–6. An important reason is because it has been found that such denier has provided optimum bulk in use. Another prior suggestion for improving bulk has been the use of hollow polyester fiberfill, e.g. as disclosed in British Pat. No. 1,168,759 and Tolliver U.S. Pat. No. 3,772,137. Commercial use of hollow polyester fiberfill has increased significantly in recent years.

Research Disclosure Journal (September 1975) Article No. 13717, page 14, discloses the inclusion in polyester fiberfill of a specific low-melting-point binder fiber, poly(ethylene terephthalate/isophthalate), and its bonding to improve the stability and handling characteristics of the fiberfill, e.g. in batts, including batts to which polysiloxane slickeners have been applied. Mixtures of polyester fiberfill with lower melting binder fiber are also suggested elsewhere, e.g. in Scott U.S. Pat. No. 4,129,675, which discloses forming a web having a central band made from silicone-slickened polyester hollow fiberfill and outer bands made from a blend of unslickened hollow polyester fiberfill and binder fiber, and forming a batt having a center layer of such silicone-slickened polyester fiberfill and upper and bottom layers of said blend. Stanistreet U.S. Pat. No. 4,068,036 suggests the use of conjugate or bicomponent fibers for use as binder fibers in fiberfill blends.

SUMMARY OF THE INVENTION

The present invention provides new fiberfill blends consisting essentially of (a) from about 70 to about 90% by weight of crimped polyester staple fiber of denier about 0.5 to less than about 3, preferably of denier about 1.5, and preferably of poly(ethylene terephthalate), and (b) complementally, to total 100% by weight, from about 10 to about 30% of crimped staple binder fiber of a polymer having a melting point lower than that of said polyester fiber, preferably of denier 0.5 to 6, and preferably of an ethylene terephthalate/ethylene isophthalate copolyester containing 65–75 mole % of ethylene terephthalate residues and, complementally, 25 to 35 mole % of ethylene isophthalate residues and a stick temperature of about 90° C., wherein from about 25 to about 75% by weight of said polyester fiber is slickened with a cured polysiloxane coating and the remainder of the polyester fiber is unslickened.

Preferred proportions of the blend are, by weight, approximately as follows: 20–25% binder fiber; 25–40% unslickened polyester fiber; and the remainder (about 35–55%) slickened polyester fiber.

DETAILED DESCRIPTION OF THE INVENTION

As indicated, the new blends consist essentially of three ingredients:

(a) (1) slickened crimped polyester staple fiber of denier about 0.5 to about 3;

(a) (2) unslickened crimped polyester staple fiber of denier about 0.5 to about 3, and (b) crimped staple binder fiber of polymer having a melting point lower than that of said polyester fiber (a).

The preferred polyester staple fiber for (a) (1) and (2) is poly(ethylene terephthalate), which is available commercially at relatively low cost and provides good tactile aesthetics. This polyester fiber (a) constitutes the predominant proportion of the blend, namely about 70 to about 90% by weight, and remains in the form of polyester fiberfill in the batt and in any garment even after heat-bonding. Preferably, the slickened ingredient (1) and the unslickened ingredient (2) are present in equal proportions by weight (50:50). The proportion of slickened ingredient (1) may, however, be increased or decreased so that the ratio of slickened (1):unslickened (2) ingredients is from 3:1 to 1:3. The use of both slickened and unslickened polyester fiberfill in combination with binder fibers is an essential characteristic of the present invention. The slickened polyester fiber is included in the blend to impart softness, drapability and down-like aesthetics, and its presence allows greater control over any needle-punching operation. It is important that the slickener be durable in the sense of being wash-resistant, so that the slickener be retained on the polyester fiberfill during normal laundering. Suitable slickeners are polysiloxane coating compositions that are available commercially, and are mentioned in the prior art, e.g. in Hofmann U.S. Pat. No. 3,271,189 and Mead et al U.S. Pat. No. 3,454,422, the disclosures of which are incorporated herein by reference. More than one type of slickener may be used, if desired. Unslickened polyester fiber is included in the blend to provide potential bonding sites where the unslickened polyester fibers cross over. The combination, in the final heat-bonded batt, of the slickened polyester fibers (which are relatively free from bonding and provide desirable tactile aesthetics) with the unslickened fibers (which provide bonding sites at their cross-over points, and so make possible the provision of a thin stable bonded structure having good recoverable stretch properties) is an important characteristic of the new blends, which are precursors of the heat-bonded batts that are used in the final articles, e.g. garments.

It will be understood that, since an important characteristic of the invention is the use of both slickened polyester fiberfill and unslickened polyester fiberfill, slickener is applied to only a portion of the polyester fiberfill, and then cured as a coating thereon before blending the slickened fiberfill with the unslickened polyester fiberfill and the binder fiber. It will generally be convenient to use the same polyester fiberfill for both slickened and unslickened ingredients, but this is not essential.

The crimped polyester staple fiber (a) is of denier less than about 3. This denier is significantly lower than that of the regular denier polyester fiberfill (denier about 5–6) that has been used commercially hitherto, and is an important characteristic of the new blend. Use of regular denier polyester fiberfill is less desirable because its thermal insulation is inferior when used in a thin heat-bonded batt, or in a thin conventional batt. As the denier of the polyester fiberfill is decreased, however, it becomes more difficult to process the fiberfill on normal textile machinery, e.g. by carding, so it is undesirable to use polyester fiberfill of denier below about 0.5. A denier of about 1.5 is preferred for the polyester fiberfill (a). Unexpectedly, it has been found that use of polyester fiberfill of about 1.5 denier in thin batts can give thermal insulation essentially equivalent to that obtainable using an equivalent weight of polyolefin microfibers (denier 0.1 or less). Such microfibers have the disadvantage that they cannot be processed on normal textile machinery, e.g. by carding. It may be desirable to use hollow polyester fiberfill for at least part of the polyester fiberfill ingredients (a) (1) and/or (2), particularly when the denier of the polyester fiberfill is in the upper portion of the denier range, e.g. about 2.5 to 3.

The third essential ingredient of the blend is the binder fiber. During heat-setting, the binder fiber melts and bonds the unslickened polyester fiberfill at the cross-over points so that the bonded batt retains the desired configuration and density. The binder is used to give the heat-bonded batts stability and recoverable stretch, whereas this function was generally performed by the quilting in previous commercial garments. Because the binder is in the form of crimped fiber, like the polyester fiberfill, it can be processed on conventional textile machinery, e.g. a card, and be distributed throughout the blend. It is desirable, therefore, that the denier of the binder fiber be compatible with the denier of the polyester fiberfill (a) so that it can be distributed throughout the blend by conventional textile processing. The denier of the binder fiber will generally be about 0.5 to about 6. Ideally, it could be preferable to use binder fiber of substantially the same denier as that of the polyester staple fiber (a) but, as indicated hereinafter, a satisfactory result can be obtained by using binder fiber of higher denier.

The amount of binder fiber is about 10 to about 30% of the blend, and preferably about 20–25% of the blend (i.e. a proportion of 1:4 to 1:3 binder fiber:polyester fiber). As the proportion of binder in the blend is increased, the resulting heat-bonded batts will generally have greater rigidity, since the amount of bonding will depend most importantly on whether binder is available to bond the unslickened polyester fiber at the cross-over points, and the statistical probability of this increases with an increase in the amount of binder and with an increase in the amount of unslickened polyester fiber. It will be understood that binder fiber is not generally present as such in the heat-bonded batts, because the binder fiber will generally melt during the heat-bonding and will then congeal on the polyester fiber during the subsequent cooling stage.

The binder fiber has a lower melting point than the polyester fiberfill. The binder fiber preferably has a stick temperature above about 80° C. and below that of the polyester fiberfill. Preferred binder fiber has a stick temperature between 80° and 200° C. Fiber stick temperature is measured as described by Beaman and Cramer, J. Polymer Science 21, page 228 (1956). A flat brass block is heated electrically to raise the block temperature at a slow rate. The fiber sample is suspended under slight tension between glass rods over and near the surface of the block. At intervals, the fiber is pressed against the block for 5 seconds with a 200 gram brass weight which has been in continuous contact with the heated block. The fiber stick temperature is the temperature of the block when the fiber sticks to it for at least 2 seconds after removing the weight.

Suitable binder fibers are described in the aforesaid Research Disclosure Journal (September 1975) Article No. 13717 on page 14, Scott U.S. Pat. No. 4,129,675 and in Stanistreet U.S. Pat. No. 4,068,036, the disclosures of which are incorporated herein by reference.

A preferred binder is composed of an ethylene terephthalate/isophthalate copolymer having a terephthalate/isophthalate molar ratio of about 65–75/35–25, and having a stick temperature of about 90° C. Such binder fiber may be used in the form of cold-drawn, relaxed fiber that has low tendency to shrink.

The staple length and crimp level of the polyester fiberfill and of the binder fiber are those conventionally used, e.g. about 3 to 15 cm and 1 to 5 crimps/cm, respectively.

If desired, the binder fiber may be in the form of a bicomponent fiber, e.g. a sheath-core fiber, the sheath of which comprises the lower melting binder polymer, as suggested in Stanistreet U.S. Pat. No. 4,068,036. In such circumstances, it is desirable to use sufficient bicomponent fiber so that the amount of binder polymer is from about 10 to about 30% of the total weight of binder polymer and polyester fiberfill.

An advantage of the new polyester fiberfill blends, in contrast with microfibers (of denier 0.1 or less), is that the blends can be made and processed conveniently into batts using conventional textile machinery. Thus the new blends are generally formed by conventional blending of the ingredients and then processed through standard carding equipment to give an unbonded batt of desired weight. The batt is then needle-punched or otherwise reduced to the desired thickness, which increases the batt density. The needle-punching is preferably carried out on both sides of the batt. The needle-punched batt is heat-treated, e.g. in a conventional oven or by use of other heating means, to melt the binder fiber distributed throughout. The heat-treated batt is then cooled to below the melting point of the binder. By this means, it is possible to prepare a thin supple batt having excellent thermal insulation and tactile aesthetic properties. Such batts may be used as insulating interliners in garments in place of the more bulky quilted batts that have generally been used heretofore.

The invention is further described in the following Example, in which all percentages are by weight, and are calculated with respect to the total of the three essential ingredients, namely (a) (1) slickened polyester fiberfill, (a) (2) unslickened polyester fiberfill and (b) binder fiber, except as otherwise indicated.

EXAMPLE

Approximately 2 pounds (1.8 kg) of the following blend was prepared by hand-mixing:

(a) (1) 40% of crimped solid poly(ethylene terephthalate) staple fiber of denier 1.5 and of staple length 1.5 in (about 4 cm), coated with a commercial silicone-oil emulsion in amount 1.4% of silicone solids based on the weight of silicone-slickened polyester fiber:

(a) (2) 40% of crimped poly(ethylene terephthalate) staple fiber of denier 1.5 and of staple length 1.5 in (about 4 cm) as in (a) (1) but unslickened, and (b) 20% of crimped fiber of denier 6, and of staple length 2 in (about 5 cm), made from an ethylene terephthalate/isophthalate copolymer having a terephthalate/isophthalate mole ratio of 70/30, of stick temperature of about 90° C., and of low shrinkage.

This blend was carded to give intimately-blended webs which were plied to give a batt of weight approximately 7.2 oz/yd$^2$ (245 g/m$^2$). The batt was needle-punched with nine-barbed needles at about 250 punches per in$^2$ (40 per cm$^2$) to increase the batt density to 0.8 lb/ft$^3$ (7.5 kg/m$^3$). The needled batt was then heat-set in an oven at 375° F. (about 190° C.) for 5 minutes. After cooling, the batt had a density of (0.93 lb/ft$^3$ (8.7 kg/m$^3$).

A sample (1 foot square, corresponding to about 30 cm×30 cm) weighing 22.2 g was sandwiched between two layers of a nylon fabric weighing 6.3 g/ft$^2$ (68 g/m$^2$) to give a composite of thickness 0.63 in (about 1.6 cm) and weighing 34.3 g. The thermal conductivity of the composite was only 0.284 BTU/hr.ft$^2$ (°F./in) (4.085 kiloergs/sec.cm$^2$ (°C./cm) measured between a hot plate at 95° F. (about 34° C.) and a cold plate at 55° F. (about 13° C.). This corresponds to a thermal insulation in CLO of 2.52, which can be calculated as 1.58 CLO/cm; note that a higher CLO value corresponds to better thermal insulation. This thermal insulation of 1.58 CLO/cm was significantly higher than that calculated for a conventional fabric of the same thickness using mainly slickened polyester fiberfill of conventional denier (5.5), as shown by the following comparative test:

A—A similar composite was prepared of thickness 0.64 in (1.6 cm) and of weight 35.2 g, 22.6 g of which comprised the heat-bonded polyester fiberfill batt. The thermal conductivity was measured by the same procedure as above. The CLO values are listed in the following Table.

B—For comparative purposes, the thermal conductivity was measured by the same procedure for a composite of the same weight, covered by the same nylon fabric, and the same weight of fiberfill, but using a batt of conventional commercial fiberfill comprising a central layer of silicone-slickened hollow polyester fiberfill in amount 60% by weight, and two outer layers of unslickened hollow polyester fiberfill, each in amount 20% by weight, this batt having been surface-spray bonded, by spraying on both sides with a commercial acrylic binder resin in total amount 10% by weight of the total fiberfill, i.e. 5% by weight on each surface, followed by heat-bonding. The CLO values of this composite are listed in the Table.

TABLE

| Item | Thickness in (cm) | CLO | CLO/100 g | CLO/cm |
|---|---|---|---|---|
| A | 0.64 (1.6) | 2.56 | 7.29 | 1.58 |
| B | 1.78 (4.5) | 4.00 | 11.37 | 0.89 |

It should be noted that the thermal insulation provided by the same weight of the conventional material is greater than that provided by the thinner fabric produced from the blend of the present invention, but the conventional material is also of much greater thickness. So, when comparing equivalent thicknesses of the two materials, significantly better thermal insulation is provided by the thin fabric of the present Example prepared from the blend of the present invention.

The above Example indicates useful proportions of the three essential constituents of the blend. Other preferred proportions are, for example; by weight:

(a) (1) 50% slickened polyester fiberfill;

(a) (2) 25% unslickened polyester fiberfill;

(b) 25% binder fibers.

I claim:

1. A polyester fiberfill blend consisting essentially of (a) from about 70 to about 90% by weight of crimped polyester staple fiber of denier about 0.5 to less than about 3, and (b) complementally, to total 100% by weight, from about 10 to about 30% of crimped staple binder fiber of a polymer having a melting point lower than that of said polyester fiber, wherein from about 25 to about 75% by weight of said polyester fiber is slickened with a cured polysiloxane coating and the remainder of said polyester fiber is unslickened.

2. A blend according to claim 1, wherein said polyester fiber is poly(ethylene terephthalate).

3. A blend according to claim 1 or 2, wherein the binder fiber is of an ethylene terephthalate/isophthalate copolyester having a terephthalate/isophthalate molar ratio of 65–75/35–25 and a stick temperature of about 90° C.

4. A blend according to claim 1 or 2, wherein the binder fiber is of denier about 0.5 to about 6.

5. A blend according to claim 1 or 2, wherein said polyester fiber is of denier about 1.5.

6. A blend according to claim 1, consisting essentially of about 20 to 25% by weight of said binder fiber, about 25 to 40% by weight of said polyester fiber that is unslickened and the remainder being said polyester fiber that is slickened with a cured polysiloxane coating.

7. A blend according to claim 6, wherein said polyester fiber is of poly(ethylene terephthalate) and of denier about 1.5, and said binder fiber is of an ethylene terephthalate/isophthalate copolymer having a terephthalate/isophthalate mole ratio of 70/30 and a stick temperature of about 90° C. and of denier about 0.5 to about 6.

* * * * *